US006068084A

United States Patent [19]

Taormina

[11] Patent Number: 6,068,084

[45] Date of Patent: May 30, 2000

[54] SAFETY RAIL

[76] Inventor: Victor J. Taormina, 10815 W. 58th Ave., Arvada, Colo. 80002

[21] Appl. No.: 09/363,488

[22] Filed: Jul. 29, 1999

[51] Int. Cl.[7] ..... E04H 17/00

[52] U.S. Cl. ..... 182/113; 248/200.1

[58] Field of Search ..... 182/113; 52/127.2; 248/200.1

[56] References Cited

U.S. PATENT DOCUMENTS

| | | | |
|---|---|---|---|
| 1,875,977 | 9/1932 | Beckwith | 248/200.1 |
| 2,594,605 | 4/1952 | Zoppelf | 248/200.1 |
| 5,943,830 | 8/1999 | Truitt | 248/354.1 |

*Primary Examiner*—Alvin Chin-Shue

[57] ABSTRACT

A safety rail for allowing temporary attachment to balconies and stairways while a conventional railing is removed thereby preventing an individual from accidentally being injured. The inventive device includes an outer member having a plurality of outer apertures, an inner member having a plurality of inner apertures that is slidably positionable within a lumen of the outer member, a first bracket attachable to the distal end of the inner member for mounting to one of the opposing support posts, and a second bracket attachable to the outer member for attachment to another of the opposing support posts. A second pin is insertable into the outer apertures and inner apertures for allowing broad adjustment of the overall length for various sizes of balconies. A threaded shaft preferably extends from the second bracket for threadable engagement with the outer member thereby allowing fine adjustment of the overall length. Another embodiment of the present invention includes a first bracket having a hook for allowing attachment about a structure without requiring fasteners. Another embodiment of the present invention includes the first bracket with a cuff member having a swivel attachment.

4 Claims, 3 Drawing Sheets

SAFETY RAIL

BACKGROUND OF THE INVENTION

1. Field of the Invention

The present invention relates generally to rail devices and more specifically it relates to a safety rail for allowing temporary attachment to balconies and stairways while a conventional railing is removed thereby preventing an individual from accidentally being injured.

2. Description of the Prior Art

Rail devices have been in use for years. Typically, a conventional railing has an upper horizontal member, a lower horizontal member and a plurality of vertical shafts that extend between the horizontal members. The horizontal members are attached between posts that are secured to the floor of the building structure. During new building construction and when replacing a conventional railing, the railing is absent thereby making a stairway or a balcony extremely dangerous for construction workers and other individuals. There is hence a need for a temporary rail system that temporarily replaces a conventional rail device.

Examples of rail devices include U.S. Pat. No. 5,842,685 to Purvis et al.; U.S. Pat. No. 4,669,577 to Werner; U.S. Pat. No. 5,683,074 to Purvis et al.; U.S. Pat. No. 4,787,475 to Arteau et al.; U.S. Pat. No. 5,314,167 to Holloman; U.S. Pat. No. 5,154,256 to Wood; U.S. Pat. No. 5,464,070 to Griek et al.; U.S. Pat. No. 5,263,550 to Jines et al.; U.S. Pat. No. 5,570,559 to Lewis which are all illustrative of such prior art.

While these devices may be suitable for the particular purpose to which they address, they are not as suitable for allowing temporary attachment to balconies and stairways while a conventional railing is removed thereby preventing an individual from accidentally being injured. Conventional railing devices are suitable when they are permanently secured, however, when the conventional railing devices are being repaired or are removed, the area is extremely dangerous for individuals.

In these respects, the safety rail according to the present invention substantially departs from the conventional concepts and designs of the prior art, and in so doing provides an apparatus primarily developed for the purpose of allowing temporary attachment to balconies and stairways while a conventional railing is removed thereby preventing an individual from accidentally being injured.

SUMMARY OF THE INVENTION

In view of the foregoing disadvantages inherent in the known types of railing devices now present in the prior art, the present invention provides a new safety rail construction wherein the same can be utilized for allowing temporary attachment to balconies and stairways while a conventional railing is removed thereby preventing an individual from accidentally being injured.

The general purpose of the present invention, which will be described subsequently in greater detail, is to provide a new safety rail that has many of the advantages of the railing devices mentioned heretofore and many novel features that result in a new safety rail which is not anticipated, rendered obvious, suggested, or even implied by any of the prior art railing devices, either alone or in any combination thereof.

To attain this, the present invention generally comprises an outer member having a plurality of outer apertures, an inner member having a plurality of inner apertures that is slidably positionable within a lumen of the outer member, a first bracket attachable to the distal end of the inner member for mounting to one of the opposing support posts, and a second bracket attachable to the outer member for attachment to another of the opposing support posts. A second pin is insertable into the outer apertures and inner apertures for allowing broad adjustment of the overall length for various sizes of balconies. A threaded shaft preferably extends from the second bracket for threadable engagement with the outer member thereby allowing fine adjustment of the overall length. Another embodiment of the present invention includes a first bracket having a hook for allowing attachment about a structure without requiring fasteners. Another embodiment of the present invention includes the first bracket with a cuff member having a swivel attachment.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a safety rail that will overcome the shortcomings of the prior art devices.

Another object is to provide a safety rail that is removably attachable to balconies and stairways of a building structure thereby temporarily replacing a conventional railing device.

An additional object is to provide a safety rail that is adjustable in length for allowing attachment in various width of areas.

A further object is to provide a safety rail that may be reused repeatedly.

Another object is to provide a safety rail that allows both broad and fine adjustment of the overall length to accommodate various width of areas.

An additional object is to provide a safety rail that is constructed of a lightweight material for allowing easy transporting.

A further object is to provide a safety rail that is capable of being contracted into a compact storage position.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
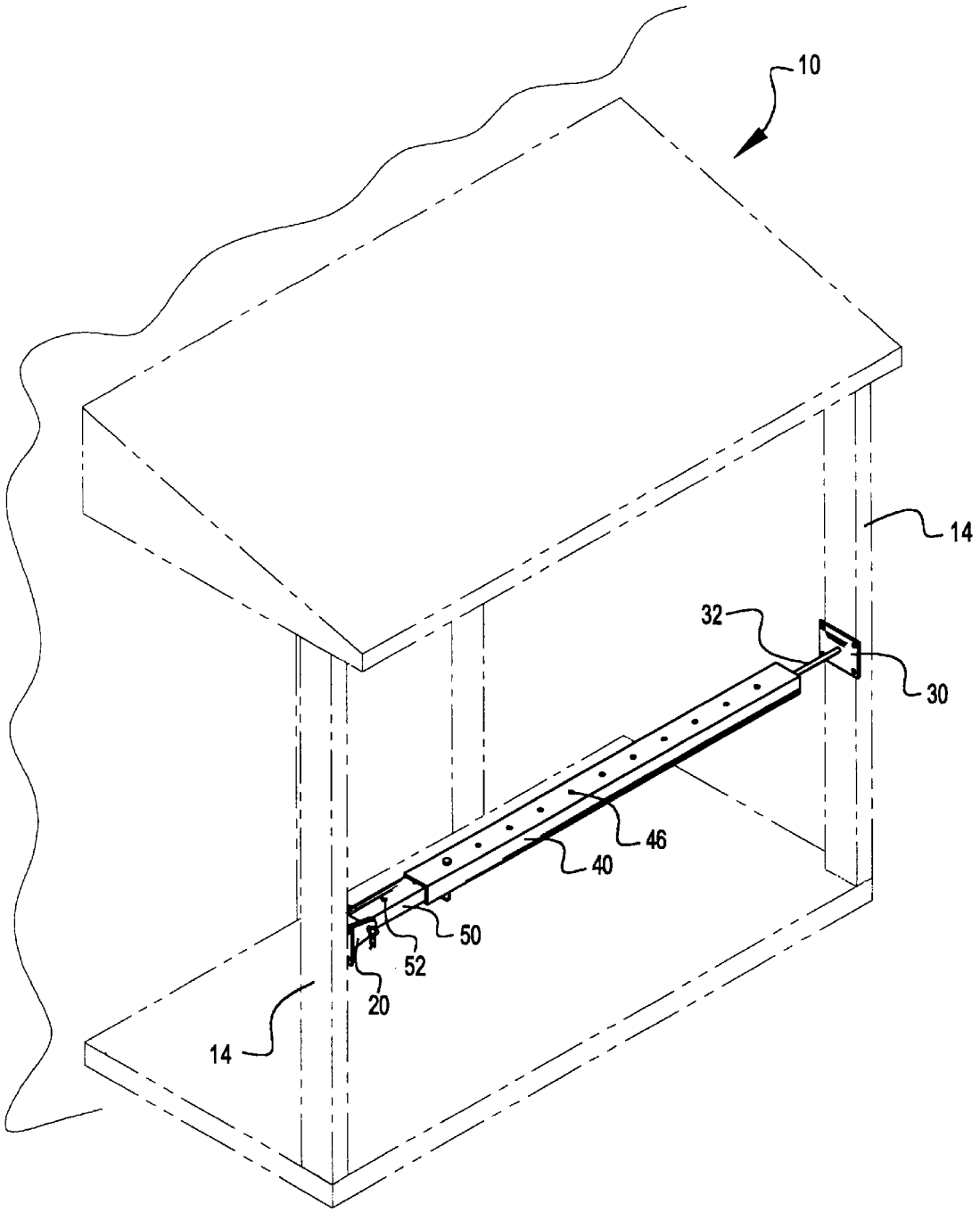
FIG. 1 is an upper perspective view of the present invention attached between opposing support posts of a balcony.

Turning now descriptively to the drawings, in which similar reference characters denote similar elements throughout the several view, FIGS. 1 through 4 illustrate a safety rail 10, which comprises an outer member 40 having a plurality of outer apertures 46, an inner member 50 having a plurality of inner apertures 52 that is slidably positionable within a lumen of the outer member 40, a first bracket 20 attachable to the distal end of the inner member 50 for mounting to one of the opposing support posts 14, and a second bracket 30 attachable to the outer member 40 for attachment to another of the opposing support posts 14. A second pin 42 is insertable into the outer apertures 46 and inner apertures 52 for allowing broad adjustment of the overall length for various sizes of balconies 12. A threaded shaft 32 preferably extends from the second bracket 30 for threadable engagement with the outer member 40 thereby allowing fine adjustment of the overall length. Another embodiment of the present invention includes a first bracket 20 having a hook 22 for allowing attachment about a structure without requiring fasteners. Another embodiment of the present invention includes the first bracket 20 with a cuff member 24 having a swivel attachment.

Figure 2:
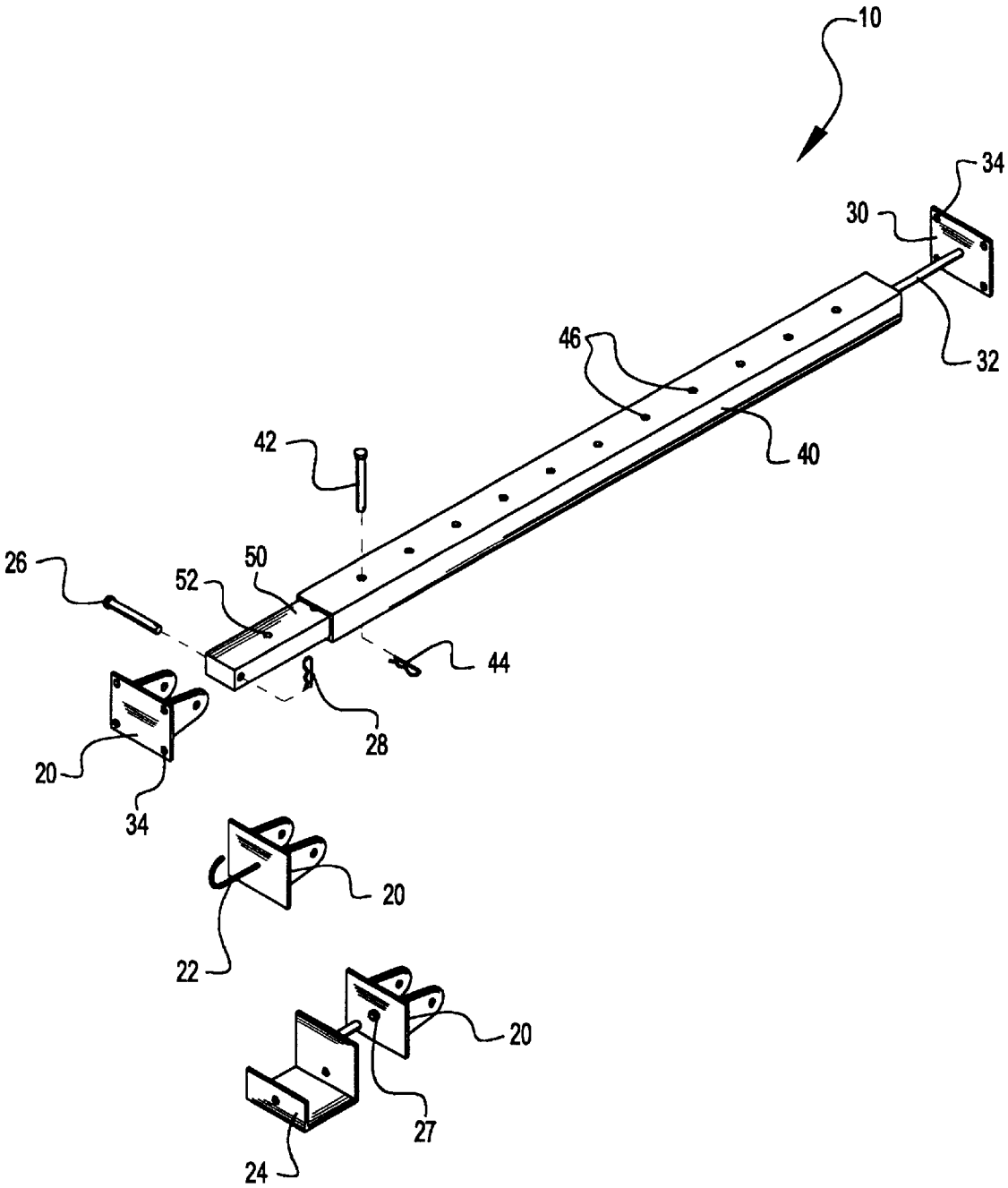
FIG. 2 is an exploded upper perspective view of the present invention.
Figure 3:
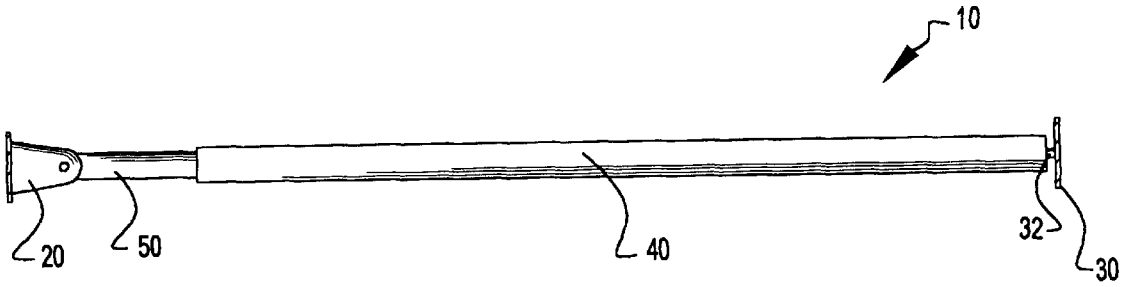
FIG. 3 is a side view of the present invention.
Figure 4:
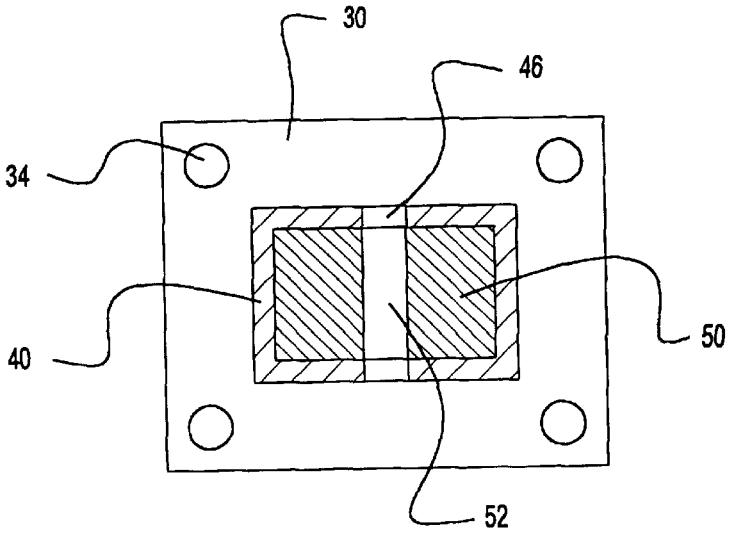
FIG. 4 is a cutaway view of the present invention showing the outer member surrounding the inner member.

As shown in FIGS. 1 through 3 of the drawings, the outer member 40 has an elongate structure. The outer member 40 preferably has a rectangular cross-sectional area, however various other shapes may be utilized. As best shown in FIG. 4 of the drawings, the outer member 40 is constructed of a tubular structure having an unnumbered lumen. As shown in FIGS. 1 and 2 of the drawings, a plurality of outer apertures 46 extend traversely through the outer member 40 for receiving the second pin 42.

As shown in FIGS. 1 through 3 of the drawings, a second bracket 30 is provided preferably having a plurality of fastener apertures 34 for securing to one of the support posts 14 or other structure. A threaded shaft 32 preferably extends from the second bracket 30 and threadably engages an end of the outer member 40 for allowing fine adjustment of the overall length of the present invention by simply rotating the threaded shaft 32 with respect to the outer member 40.

As shown in FIGS. 1 through 4 of the drawings, an inner member 50 is slidably positioned within the outer member 40 for allowing adjustment of the overall length of the present invention. The inner member 50 includes a plurality of inner apertures 52 that correspond with the outer apertures 46 for receiving the second pin 42 as shown in FIG. 4 of the drawings. When the user achieves the approximate length of the invention desired, the user inserts the second pin 42 through the outer apertures 46 of the outer member 40 and through the inner apertures 52 of the inner member 50 thereby retaining the relative positions of the inner member 50 and outer member 40. A second clip 44 is positionable within the second pin 42 for preventing accidental removal of the second pin 42. It can be appreciated that other means can be utilized for retaining the second pin 42 within the outer member 40 and the inner member 50.

A first bracket 20 is provided having a plurality of fastener apertures 34 similar to the second bracket 30. The first bracket 20 has a pair of extended members having an aperture that mate with an aperture within the distal end of the inner member 50 for receiving a first pin 26 as shown in FIG. 2 of the drawings. A first clip 28 is positionable within the first pin 26 for preventing accidental removal of the first pin 26. It can be appreciated that other means can be utilized for retaining the first pin 26 within the outer member 40 and the inner member 50.

In an alternative embodiment of the present invention, the first bracket 20 includes a hook 22 member instead of the plurality of fastener apertures 34 for allowing attachment to a structure. The hook 22 extends from a plate portion of the first bracket 20 opposite of the pair of extended members. In a second embodiment, a cuff member 24 is attached to the first bracket 20 by a swivel coupler 27 for allowing pivotal and rotational positioning of the first bracket 20. The swivel coupler 27 is mechanically attached between the cuff member 24 and the first bracket 20. The swivel coupler 27 is comprised of any well-known swivel joint structure such as a ball and joint system. The swivel coupler 27 allows 360 degree rotation along with 180 degree radial pivoting.

In use, the user secures the first bracket 20 to the building structure such as the support posts 14 of a balcony 12. The user then attaches the inner member 50 within the first bracket 20 by utilizing a first pin 26 with a first clip 28 attached thereto. The user then removes the second pin 42 and extends the outer member 40 from the inner member 50 until the second bracket 30 is close to the support posts 14 as shown in FIG. 1 of the drawings. The user then inserts the second pin 42 through the outer apertures 46 and the inner apertures 52 for locking the relative positions of the outer member 40 and the inner member 50 with one another. The user then rotates the second bracket 30, if required, for allowing fine adjustment of the overall length of the present invention until the second bracket 30 is adjacent one of the support posts 14. The user then attaches the second bracket 30 to the support posts 14 as shown in FIG. 1 of the drawings. When the user is ready to install the permanent railing, the present invention is simply removed without having any significant damage to the building structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A safety rail, comprising:

a first bracket attachable to a building structure;

a second bracket attachable to an opposing side of said building structure;

an outer member having a tubular construction, wherein said outer member is attachable to said second bracket;

an inner member slidably positioned within said outer member, wherein said inner member is attachable to said first bracket;

wherein said outer member and said inner member both include a plurality of corresponding apertures for receiving a pin for preventing movement of said inner member with respect to said outer member;

wherein said first bracket includes a pair of extended members having an aperture that corresponds with an aperture within a distal end of said inner member for receiving another pin;

wherein said second bracket includes a threaded shaft extending therefrom for threadable engagement with said outer member; and wherein said first bracket includes a cuff member attached to said first bracket by a swivel coupler.

2. The safety rail of claim 1, wherein said second bracket includes a plurality of aperture for receiving a plurality of fasteners.

3. The safety rail of claim 1, wherein said outer member and said inner member have a rectangular cross-sectional area.

4. The safety rail of claim 3, wherein said outer member and said inner member is constructed of a lightweight material.

* * * * *